US006841015B1

(12) United States Patent
Baker

(10) Patent No.: US 6,841,015 B1
(45) Date of Patent: Jan. 11, 2005

(54) DELAY ELEMENT AND IGNITION COMPOSITION

(75) Inventor: James J. Baker, Waldorf, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/681,500

(22) Filed: Oct. 9, 2003

(51) Int. Cl.[7] ..... C06B 45/10; C06B 33/00; D03D 23/00

(52) U.S. Cl. ..... 149/19.2; 149/37; 149/108.6

(58) Field of Search ..... 149/37, 116, 108.6, 149/77, 19.2

(56) References Cited

U.S. PATENT DOCUMENTS

| | | | | | |
|---|---|---|---|---|---|
| 2,791,114 | A | * | 5/1957 | Cressman | 431/362 |
| 3,171,764 | A | | 3/1965 | Parker et al. | 149/19.6 |
| 3,197,349 | A | | 7/1965 | Essen-Bredeney et al. | 149/19.2 |
| 3,366,054 | A | * | 1/1968 | Gruber, Jr. | 102/202.11 |
| 3,411,964 | A | * | 11/1968 | Douda | 149/19.2 |
| 3,453,156 | A | | 7/1969 | Hackett et al. | 149/19.2 |
| 3,587,467 | A | | 6/1971 | Menke et al. | 102/202.13 |
| 3,945,322 | A | * | 3/1976 | Carlson et al. | 102/275.4 |
| 3,964,256 | A | | 6/1976 | Plantif et al. | 60/219 |
| 3,986,908 | A | | 10/1976 | Grebert et al. | 149/19.7 |
| 4,332,631 | A | | 6/1982 | Herty, III et al. | 149/19.2 |
| 4,358,998 | A | | 11/1982 | Schneiter et al. | 102/530 |
| 6,647,887 | B2 | * | 11/2003 | Smith et al. | 102/275.1 |
| 6,666,476 | B2 | * | 12/2003 | Rink et al. | 280/741 |
| 2002/0014076 | A1 | | 2/2002 | Blackburn et al. | 60/508 |
| 2002/0035945 | A1 | | 3/2002 | Knowlton et al. | 102/275.3 |
| 2002/0079680 | A1 | | 6/2002 | Moquin et al. | 280/736 |

* cited by examiner

*Primary Examiner*—Aileen Felton
(74) *Attorney, Agent, or Firm*—Mark Homer

(57) ABSTRACT

A high temperature combination delay element and ignition composition contains a polymeric silicone component, an oxidizer component and a high temperature metal component.

9 Claims, No Drawings

DELAY ELEMENT AND IGNITION COMPOSITION

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

The present invention provides a combination delay element and high temperature ignition composition.

2. Brief Description of the Related Art

Mixtures of RTV and potassium perchlorate that burn at a flame temperature of about 3000° F. have been used to ignite hard to ignite materials. These mixtures give off hot particles of potassium chloride and silicon dioxide, which impact the material to be ignited and initiate the reaction. However, these mixtures are limited in their maximum flame temperature.

There is a need in the art to provide an ignition composition with high burn temperatures. The present invention addresses this and other needs.

SUMMARY OF THE INVENTION

The present invention includes a combination delay element and ignition composition comprising a polymeric silicone component, an oxidizer component and a high temperature metal component. Preferably, the composition additionally includes a magnesium component. In one preferred embodiment the composition is formed into a cord configuration.

Preferably, the combination delay element and ignition composition of the present invention includes RTV in an amount of about 10 wt %, potassium perchlorate in an amount of about 67.5 wt %, aluminum powder in an amount of about 17.5 wt %, and magnesium powder in an amount of about 5 wt %.

DETAILED DESCRIPTION OF THE PREFERRED EMBODIMENT

The present invention includes a combination delay element and ignition composition useful in the form of a cured cord. The composition includes a polymeric silicone component, an oxidizer component and a high temperature metal component, with an optional component of magnesium.

The silicone polymers of the present invention include silicone structured polymers of repeating silicon and oxygen atoms with various substituents attached to the silicone. The silicone component includes an unfilled curable silicone polymer. Silicone includes such compositions as RTV (room-temperature-vulcanizing), low temperature curing 1-part silicone, low temperature curing 2-part silicone, high temperature curing 1-part silicone, high temperature curing 2-part silicone, and the like. Preferably, the silicone component comprises RTV, such as those manufactured by General Electric Corporation and sold under the tradename GE II or RTV615B. Other suitable RTV'S include, without limitation, Sylgard 184 manufactured by Dow Corning. Representative amounts of the silicone component include, for example without limitation, from about 5 wt % to about 20 wt %, preferably from about 5 wt % to about 15 wt %, and most preferably about 10 wt %. The polysiloxane polymers of the present invention maybe crosslinked at room temperature, ie., about 23° C. The polysiloxane polymers which can be employed are low molecular weight polymers having a viscosity that permits casting, which may be complimented by the addition of low viscosity (about 50 cps) silicone diluents or plasticizers. Substituents of the organosiloxane polymers may include, without limitation, methyl, ethyl, methoxy, amino, phenyl, etc. Additionally, siloxane and its derivatives may be used. Representative silicone polymers include polydimethylsiloxane (PDMS), however, other silicones are also suitable.

The oxidizer component of the present invention may be selected from perchlorates, nitrates, peroxides and combinations thereof, and the like, such as alkali metal nitrates, complex salt nitrates and nitrites, dried, hydrated nitrates, alkali metal chlorates and perchlorates, alkaline earth metal chlorates and perchlorates, complex salt nitrites, solid organic nitrates, nitrites and amines, and mixtures and co-melts thereof. Representative oxidizers include ammonium perchlorate, potassium perchlorate, sodium nitrite, ammonium nitrate, potassium nitrite, silver nitrite, and the like. Preferably, the oxidizer component includes potassium perchlorate. Representative amounts of the oxidizer component include from about 55 wt % to about 80 wt %, preferably from about 60 wt % to about 75 wt %, and most preferably from about 65 wt % to about 70 wt %.

Representative high temperature metals of the present invention include, for example, aluminum, boron, aluminum alloys, aluminum hydrides and combinations thereof. Of these, aluminum is preferred. The high temperature metal is present in an amount that effectively function to provide a combination delay element and ignition composition, such as from about 15 wt % to about 20 wt %, more particularly about 17.5 wt %. Particle sizes of the aluminum component may include, for example, from about 100 nanometers to about 100 micrometers. The form of the aluminum may include spherical, such as that produced by the atomizing process, or flake, such as that commonly used in the paint industry. Flake aluminum is the preferred form. The size of the individual flakes may range from about 20 to about 500 microns long, about 5 to about 500 microns across, and about 1 to about 100 microns thick.

An additional component includes magnesium that provides chemical properties that readily ignite the composition from an external heat source. The magnesium of the present invention employed in the combination delay element and ignition composition may comprise particle magnesium, such as spherical, flake or powder magnesium, and combinations thereof. Representative spherical magnesium includes high content atomized magnesium, such as 95% magnesium or greater content, with particle sizes of from about 100 microns. or less, or flake magnesium with greater than 90% magnesium content. Representative amounts of magnesium include, for example without limitation, less than from about 10 wt %, such as about 5 wt %. Powder magnesium is preferred.

In one particularly preferred embodiment, the present invention includes a polymeric silicone component of RTV in an amount of about 10 wt %, an oxidizer component of potassium perchlorate in an amount of about 67.5 wt %, a high temperature metal component of aluminum powder in an amount of about 17.5 wt % and magnesium powder in an amount of about 5 wt %.

The composition of the present invention provides high flame temperatures capable of igniting hard to ignite materials. Flame temperatures range, for example, at greater than about 3500° F., such as from about 3500° F. to about 8000° F., including 4000° F, 4500° F., 5000° F., 5500° F., 6000° F., 6500° F., 7000° F., etc., and temperature therebetween, that are capable of readily igniting hard to ignite materials, such as titanium-boron mixtures, such as those referred to as HTI, HTTR or the Vulcan Fire, generally having the composition of 20% Teflon powder, 5% CTBN binder, 61% titanium powder, and 14% boron powder and the like.

The composition of the present invention is preferably used in a combination delay and ignition cord. The cord configuration allows predictable burn time (delay) before it causes ignition of hard to ignite materials, while allowing a form that is readily manipulable for practical applications of the composition.

COMPARATIVE EXAMPLE

GE RTV615, part A was mixed sequentially with GE RTV615, part B and potassium perchlorate, in amounts of 36.4%, 3.6% and 60.0%, by weight, respectively. The calculated flame temperature of the composition was 3,140° F.

EXAMPLE 1A

GE RTV615, part A was mixed sequentially with GE RTV615, part B, flake potassium perchlorate and aluminum, in amounts of 14.56%, 1.44%, 66.50% and 17.50%, by weight, respectively. The calculated flame temperature of the composition was 6,187° F. The composition of Example 1 showed fluid characteristics that was easy to process. The addition of the potassium perchlorate before the aluminum allowed the aluminum the be quickly incorporated into the mix.

EXAMPLE 1B

GE RTV615, part A was mixed sequentially with GE RTV615, part B, flake aluminum, magnesium and potassium perchlorate, in amounts of 18.2%, 1.8%, 5.0%, 5.0% and 70.0%, by weight, respectively. The calculated flame temperature of the composition was 5,592° F.

EXAMPLE 1C

GE RTV615, part A was mixed sequentially with GE RTV615, part B, flake aluminum, magnesium and potassium perchlorate, in amounts of 9.1%, 0.9%, 17.5%, 5.0%, and 67.5%, by weight, respectively. The mix was made at 10 grams. The calculated flame temperature of the composition was 6,742° F. The composition of Example 3 resulted in a damp powder that was pressed into a pellet.

EXAMPLE 2

Safety tests were performed on the compositions of the Comparative Example, Examples 1A–1C, and RDX, with the RDX used as a reference for additional comparison.

| Test | Comparative | 1A | 1B | 1C | RDX |
|---|---|---|---|---|---|
| NOS impact, 50% (mm) | 287 | 409 | 344 | 235 | 355 |
| ABL Friction, 20TIL (psig) | 560 | 180 | 135 | 75 | 180 |
| ABL ESD 20TIL (joules) | >8.33 | 4.20 | 1.72 | 1.72 | 0.165 |

EXAMPLE 3

The composition of Example 1A was repeated on a larger scale using a one-pint mixer. The mix was made at 400 grams. After mixing was completed, the mass was formed into a block for further testing. A differential scanning calorimeter (DSC) was used to determine the thermal stability of the mixture. Only an endotherm was found at a temperature of 300° C. (572° F.), showing thermal stability of the mixture.

EXAMPLE 4

A wire was placed across a 10-gram piece of the block from Example 3. Sufficient current was passed through the wire to cause it to glow red-hot. After a few seconds, the sample ignited and burned with an intense white flame.

The foregoing summary, description, and examples of the present invention are not intended to be limiting, but are only exemplary of the inventive features which are defined in the claims.

What is claimed is:

1. A combination delay element and ignition composition, comprising:

an unfilled curable polymeric silicone component, present in an amount of from about 5 weight percent to about 15 weight percent;

an oxidizer component, comprising potassium perchlorate and present in an amount of from about 60 weight percent to about 75 weight percent;

a high temperature metal component, comprising from about 15 weight percent to about 20 weight percent and being selected from the group of aluminum, boron, aluminum hydrides, or combinations thereof; and, wherein the composition is cured into a configuration suitable for a delay element.

2. The composition of claim 1, wherein the silicone component comprises RTV.

3. The composition of claim 1, wherein the silicone component is present in an amount of about 10 wt %.

4. The composition of claim 3, wherein the oxidizer component is present in an amount of from about 65 wt % to about 70 wt %.

5. The composition of claim 4, wherein the high temperature metal comprises aluminum.

6. The composition of claim 5, wherein the high temperature metal is present in an amount of about 17.5 wt %.

7. The composition of claim 1, further comprising about 5 percent by weight magnesium.

8. The composition of claim 1, wherein the polymeric silicone component comprises RTV in an amount of about 10 wt %, the oxidizer component comprises potassium perchlorate in an amount of about 67.5 wt %, the high temperature metal component comprises aluminum powder in an amount of about 17.5 wt %, and further comprising magnesium powder in an amount of about 5 wt %.

9. The composition of claim 1, wherein the composition is cured into a cord configuration.

* * * * *